US009689206B2

(12) United States Patent
Weston

(10) Patent No.: US 9,689,206 B2
(45) Date of Patent: Jun. 27, 2017

(54) LADDER SAFETY DEVICE FOR USE WITH GUTTERS

(71) Applicant: Joseph M. Weston, Sparta, NJ (US)

(72) Inventor: Joseph M. Weston, Sparta, NJ (US)

( * ) Notice: Subject to any disclaimer, the term of this patent is extended or adjusted under 35 U.S.C. 154(b) by 37 days.

(21) Appl. No.: 14/976,542

(22) Filed: Dec. 21, 2015

(65) Prior Publication Data

US 2016/0348435 A1 Dec. 1, 2016

Related U.S. Application Data

(60) Provisional application No. 62/230,274, filed on Jun. 1, 2015.

(51) Int. Cl.
*E06C 7/48* (2006.01)

(52) U.S. Cl.
CPC ..... *E06C 7/486* (2013.01); *E06C 7/48* (2013.01)

(58) Field of Classification Search
CPC ..... E06C 7/486; E06C 7/48
See application file for complete search history.

(56) References Cited

U.S. PATENT DOCUMENTS 4,580,661 A * 4/1986 Thomson, Jr. ..... E06C 7/486 182/107
4,924,971 A * 5/1990 Rice ..... E06C 1/34 182/107
8,439,163 B2 * 5/2013 Inman ..... E06C 7/183 182/107
8,550,422 B1 * 10/2013 Thomas ..... E06C 7/486 108/27
2009/0064743 A1 * 3/2009 Gee ..... A01M 31/02 70/263

* cited by examiner

*Primary Examiner* — Alvin Chin-Shue
(74) *Attorney, Agent, or Firm* — Brown & Michaels, PC

(57) ABSTRACT

A ladder safety device and kit includes gutter grabber devices that attach to a gutter. The gutter grabber devices are mounted on the gutter lip and fit the ladder's rail to neutralize side to side movement as the ladder rail potentially can slide across the gutter's edge as the user climbs it and mounts the roof. The safety device also includes a ratchet and lashing strap device to hold the ladder firmly to the gutter when any force, such as accidental kickback, pushes the ladder away from the gutter. Working in tandem, the gutter grabber devices and the safety strap with a ratchet and hooks virtually eliminate significant side to side as well as front to back movement of the ladder, preventing the ladder from slipping, while having a convenient and compact design allowing it to be carried around easily by the user.

18 Claims, 7 Drawing Sheets

LADDER SAFETY DEVICE FOR USE WITH GUTTERS

REFERENCE TO RELATED APPLICATIONS

This application claims one or more inventions which were disclosed in Provisional Application No. 62/230,274, filed Jun. 1, 2015, entitled "GUTTER GRABBER SAFETY KIT". The benefit under 35 USC §119(e) of the United States provisional application is hereby claimed, and the aforementioned application is hereby incorporated herein by reference.

BACKGROUND OF THE INVENTION

Field of the Invention

The invention pertains to the field of ladder safety devices. More particularly, the invention pertains to an attachment for preventing ladders from slipping during use against a gutter.

Description of Related Art

When a ladder is planted on a surface that is less than perfectly level, flat, or firm, or when a ladder user does not use perfect precision climbing the ladder and roof, the ladder may be subject to movement as a gutter is smooth and slippery, and that can throw the user off balance as he relies on it to be stationary. When a ladder is placed against a gutter, it is subject to two kinds of movement that can cause the user to lose his balance. One is a backward force such as accidentally kicking the ladder away while working or standing on a ladder, or a strong gust of wind that blows the ladder down while the user is, for example, on a roof. The other is a sideward movement as the ladder slides to the left or right while the user mounts or dismounts the ladder, which can be caused by imperfect "step-on-rung" or "hand-on-rail" balancing. This may alternatively be caused by a ground surface that is not sufficiently firm and level. This type of ladder movement against these surfaces is very common and even slight side to side movement poses a threat to the user trying to maintain his balance during that short crucial moment of mounting or dismounting the ladder.

For example, when a ladder is placed against a gutter and the user is going to mount the roof above the eaves, the user takes a risk both when climbing onto the roof and when dismounting the roof back onto the ladder. Since the ladder and gutter are both usually made of smooth, flat aluminum, it does not take much pressure to cause the ladder to slide to the left or right as the user steps up and down on the rungs. This movement can happen if the user does not dismount and remount the ladder with perfect balance, or the movement can be caused by landscaping that is not ideally flat, firm and level. Thus, there is a need for a safety device to keep the ladder rail held firmly against surfaces such as the gutter and keep the user from losing his balance.

There are currently no devices on the market to solve the problem effectively. All current solutions are ineffective, bulky, expensive, cumbersome, and/or inconvenient to use. One attempted solution uses a clamp and a large foam rubber mat that lays over the gutter. Yet, the rubber mat and clamp do not prevent all risk scenarios, especially front to back movement. Other attempts to solve the problem include ladder pads and similar devices, which provide only minimal protection. Other attempted solutions include the use of multiple parts, many screws and bolts, complex assembly steps, and/or require much time and effort, Additionally, many of these methods and devices require the user to get down from the ladder to get the safety device and come back up with the large or inconvenient device. Many ladder users decide to take what they perceive to be a small risk, assuming that the worst case scenario will not happen, instead of undergoing the inconveniences provided by the currently available preventive safety measure. Therefore, there is a need in the art for a convenient device that can be carried in a snap packet on the user's belt, or in his pocket, and can effectively prevent a ladder from slipping and causing an accident.

SUMMARY OF THE INVENTION

The present invention solves all the above problems while making the safety device easy to use and carry. The solution has a twofold approach. It uses one type of device, the gutter grabbers, which can be mounted on the surface against which the ladder rests and fits the ladder rail, and are made of material, such as rubber, that can create friction and absorb low level force to resist side to side movement. The solution also uses a safety strap and a ratchet, with one hook attached to the surface against which the ladder rests and the other hook attached to the ladder rung immediately below, to keep the ladder against the surface at all times, including a kickback force that can push the ladder away from the surface. The gutter grabber devices are tethered to the safety strap prior to attachment so the user cannot accidentally drop them to the ground before attaching them to the edge of the gutter.

The ladder safety kit is also preferably designed to work on gutters that have gutter guards.

The device is wearable on a user's belt or can be used in a user's pocket so it always would be available to the user. The invention addresses the side to side and front to back movement separately as well as working in tandem. The use of rubber or similar material makes the gutter grabber devices small, lightweight and inexpensive.

DETAILED DESCRIPTION OF THE INVENTION

Figure 1:
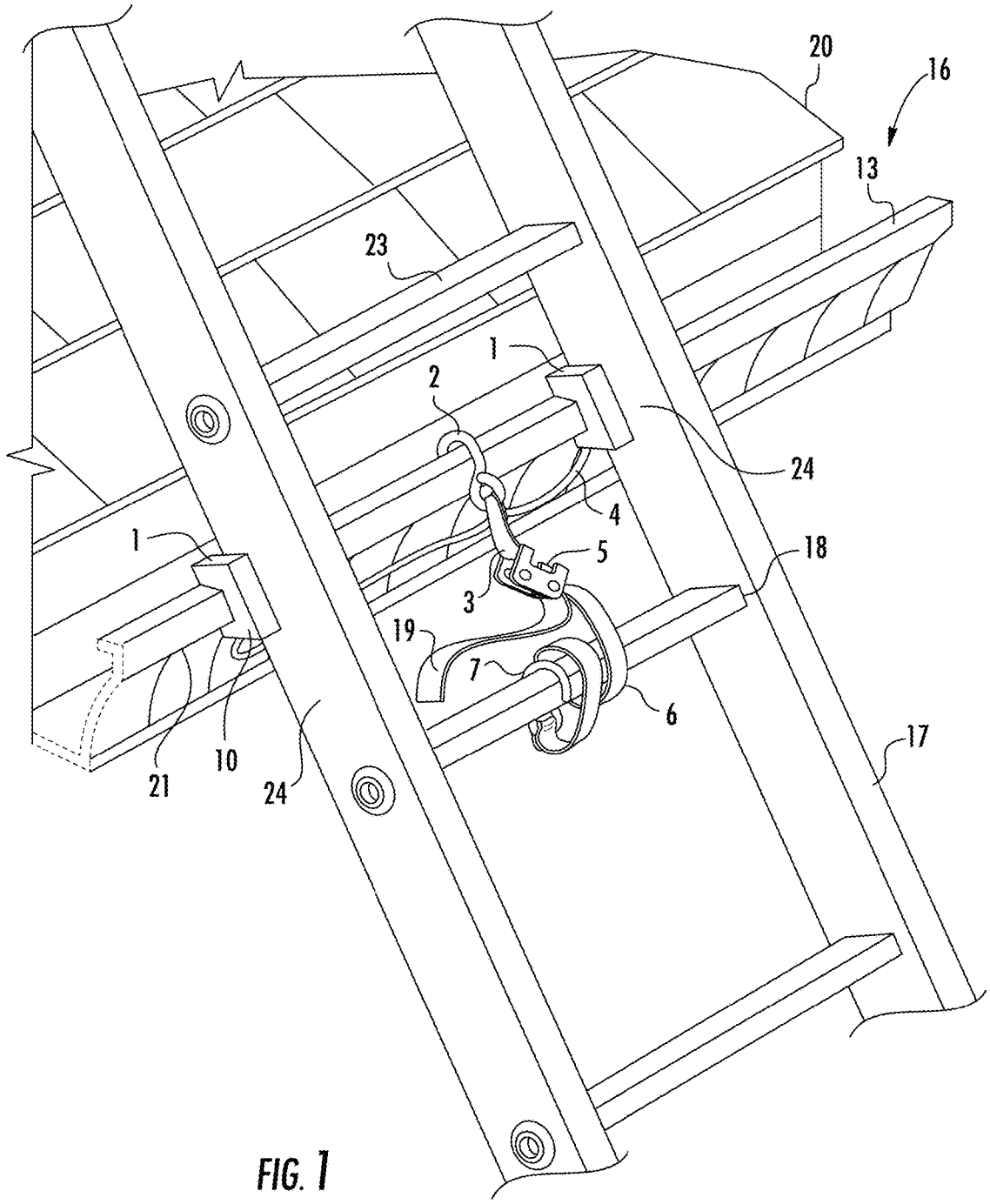
FIG. 1 is a perspective view of an embodiment of the present invention, which includes a gutter edge, a ladder, gutter grabber devices, a hook, short straps, gutter grabber straps, a ratchet device, a lashing strap, and a ladder hook.

The devices and methods of the present invention solve all the above problems while making the safety device compact and easy to use and carry. The device includes multiple elements to increase the safety of ladder use. It uses one type of device, gutter grabber devices, which are shaped to connect to the ladder, as well as the gutter. One side of the gutter grabber devices are shaped to fit inside the ladder rail, are mounted on the surface against which the ladder rests and fit the ladder rail. The opposite side of the gutter grabber devices has a channel to fit onto the gutters. The gutter grabber devices are preferably made of a material that can create friction and absorb low level force to resist side to side movement. The gutter grabber devices may be made of any material that is soft and pliable, including, but not limited to, rubber. The device also preferably uses a safety strap and a ratchet (such as lashing straps with a ratchet), with a first hook that can preferably be latched onto the surface against which the ladder rests and a second hook preferably attached to the ladder rung immediately below. This keeps the ladder against the surface at all times, even when there is a kickback force that pushes the ladder away from the surface. The gutter grabber devices are preferably tethered to the safety strap prior to attachment so the user cannot accidentally drop them to the ground before attaching them to the edge of the gutter.

The gutter grabber devices work in tandem with the ratchet and strap assembly to hold the ladder tightly against the gutter; and each separately will not keep the ladder held firmly in all directions during typical roof mounting. As an analogy, the safety strap and ratchet assembly act similar to the brakes of a car and the gutter grabber devices act similar to the tires of a car. The result is that the two components of the safety device act together to secure the ladder, much like the brakes and tires act together to stop a car.

In some preferred embodiments, the device of the present invention is wearable on a user's belt or can be used in a user's pocket so it always would be available to the user. The invention addresses the side to side and front to back movement separately as well as in tandem. The use of rubber or a similar material makes the gutter grabber devices small, lightweight and inexpensive.

In addition, while it is preferred that the gutter grabber devices be used in combination with the other components of the safety device to maximize safety, the gutter grabber devices may alternatively be utilized without the ratchet-operated lashing strap. The gutter grabber devices are preferably only used alone in situations where the left to right movement of the ladder on the gutter is the primary or only risk. As one example, if it is a windy day, and the ladder user needs to leave the ladder leaning against the gutter unattended, the user may attach the gutter grabber devices alone, since the user is concerned only with the ladder not moving left or right or falling to the ground due to the wind or other forces. As another example, the user may use the gutter grabber devices alone if the ladder is placed over a gutter not far from the ground and at a less acute angle, limiting the risk of kickback. Again, in this situation, the user is concerned primarily with left to right movement.

A ladder safety device or kit is used to prevent a ladder from slipping when the ladder is mounted against a metal gutter or a similar surface. Gutter grabber devices are mounted on the surface against which the ladder rests and fits the ladder rail to prevent side to side movement. The safety device also includes a ratchet and lashing strap device to prevent front to back movement. Each of the two separate devices effectively neutralizes their respective resistance to the two different types of potential forces, each coming from opposite directions, providing the user with maximal protection from ladder movement. The effectiveness of a safety device including both the ratcheting and straps and the gutter grabber devices is also due to the advantage of the devices being small enough to fit into a case mountable to a tool belt. This makes the device much more likely to be employed than if the item had to be dug out from a truck or garage and then be carried up the ladder. Once the user takes the safety device out of the case or his pocket while on the ladder, there is no chance he will accidentally drop the gutter grabber devices as they will be tethered to the safety strap.

The gutter grabber devices are designed to work on gutters that have gutter guards. Gutter guards (also known as leaf guards) are typically composed of hard screening, usually made of metal, that are mounted to the gutters to prevent leaves from entering the gutters, while allowing rainwater to enter the gutters. Gutter guards are becoming increasingly popular, yet most ladder-on-gutter safety devices in the prior art, as well as all of the safety devices currently on the market, do not work with gutters that have gutter guards.

While using the devices described herein, the user should follow all general precautions regarding use of a ladder. For example, the ladder user preferably still needs to adjust the positioning of the ladder against the surface the ladder is leaning on, so the ladder when raised is not listing more than 3 degrees off a 90 degree vertical. The ladder user also preferably needs to place the ladder rail against the gutter so that the climb up angle is between 25 and 30 degrees off a 90 degree vertical. In addition, the ladder should be positioned so that three rungs are above the gutter and that the fourth rung down allows enough space to step on when climbing onto the roof.

When the safety device described herein is used in combination with a carrying case and a tool belt, the safety device should always be returned to the carrying case on the tool belt the user is wearing to ensure it is conveniently accessible whenever the user is on the ladder.

FIG. 1 illustrates a preferred embodiment of the invention. FIG. 1 includes a gutter edge 13, a ladder 17, gutter grabber devices 1, a gutter hook 2, connecting straps 3, gutter grabber straps 4, a ratchet device 5, a lashing strap 6, and a ladder hook 7. The ladder 17 rests on the gutter 16. The gutter grabber devices 1 are used to secure the ladder rails 24 to the gutter 16 by snugly connecting to both the gutter 16 and a rail 24 of the ladder 17. The gutter grabber devices 1 neutralize any low-level pressure placed on the ladder 17 that would otherwise cause the ladder 17 rail to slide to the left or right. The two gutter grabber devices 1, one for each side of the ladder 17 rail, are preferably comprised of soft, sponge-like material, such as rubber, to create friction and absorb low level force to keep the ladder from moving sideways across the gutter. In some preferred embodiments, the gutter grabber devices are approximately 2½" long by 1¾" wide.

Figure 4A:
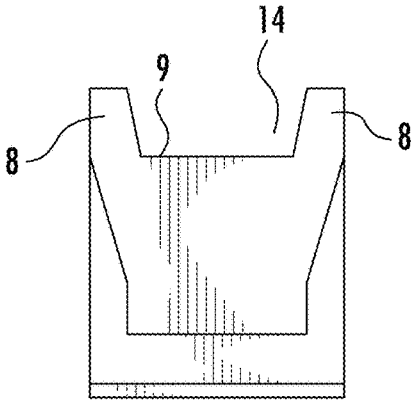
FIG. 4A is a top view of the gutter grabber device, showing the ladder rail face.
Figure 5A:
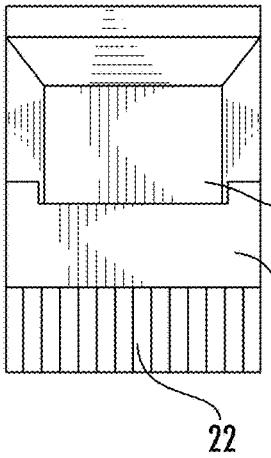
FIG. 5A is a rear view of the gutter grabber device, showing the gutter face.

The gutter grabber devices 1 are not designed to mitigate any force in the direction away from the gutter 16. Each gutter grabber device has a body 10, with a ladder rail face, shown in FIGS. 2, 4A and 7A, and a gutter face, shown in FIGS. 3, 5A and 6A. The gutter face includes a channel 15 molded to snugly fit the shape of a gutter's upper edge 13 and lower lip 21. The ladder rail face has two substantially parallel side walls 8, an interior wall 9 and a groove or channel 14. The channel 14 is shaped to fit the ladder's rail 24. To mount the ladder 17 into the gutter grabber devices 1, when the user's face is about level with the gutter 16, the user pushes the ladder 17 up and lowers the ladder rail 24 into the grooves 14 on the ladder rail face of the gutter grabber devices 1.

Figure 10:
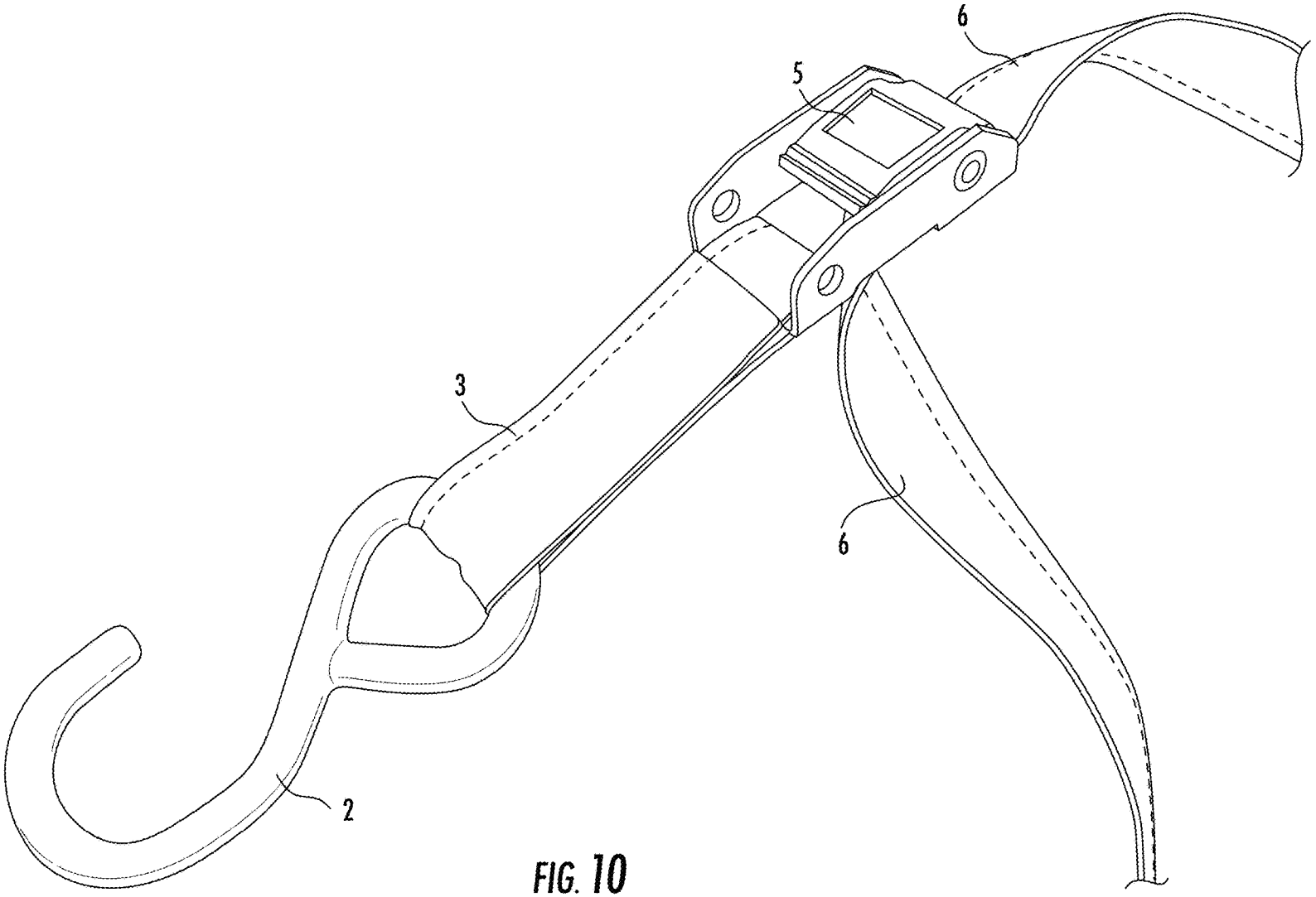
FIG. 10 shows an example of the lashing strap and ratchet.

FIG. 1 also shows a "push to release tension" ratchet device 5 with a lashing strap 6, which tightly adheres the gutter 16 to the ladder rung 18 that is immediately below the gutter 16. FIG. 10 shows a more detailed view of an example of the ratchet 5 and lashing strap 6. Although a particular type of ratchet device 5 is shown in the figures, any ratchet 5 and lashing strap 6 that is compact, strong, and easy and quick to activate and adjust could be used. In some preferred embodiments, the ratchet is 1¼ inches long. In a preferred embodiment, the safety strap 6 uses either a ½" size lashing strap 6 which threads through the ratchet device 5. In a preferred embodiment, the lashing strap 6 is 20 inches long including the loose end 19 used for pulling the strap 6 taut. In preferred embodiments, the lashing strap 6 is ⅜ inches or ½ inches wide. There is more than enough slack to wrap the strap 6 around the ladder rung 18 at least twice to reinforce the effectiveness of the strap 6.

A gutter hook 2 on one end of the lashing strap 6 is attached to the inside of the gutter 16. The size and shape of the gutter hook 2 lets it be threaded through a leaf guard on the gutter to allow hooking it to this type of gutter, as well as with a bare gutter or gutters with mesh type guards. In some preferred embodiments, the gutter hook 2 has a ⅜ inch radius semicircle around a center point plus a ¼ inch extension. The gutter hook 2 is preferably designed so that it will go through a gutter guard if one is in place. The other end of the lashing strap 6 has a custom-made ladder hook 7 designed to effectively grab the ladder rung 18. The ladder hook 7 preferably lays flat along the "step-on" face of the rung 18 so as not to create an obstacle to the user stepping on the ladder rung as he mounts the roof 20. In preferred embodiments, the hooks are ⅛ inch in diameter and/or made of steel. The loose end 19 of the ratchet device 5 is pulled by the user to tighten the grip of the ladder 17 to the gutter 16. The safety strap 6 is not designed to mitigate any force causing the ladder rail 24 to slide across the gutter's edge 13. There are also connecting straps 3, which are preferably double reinforced, that attach to the simple ratchet 5 and the gutter hook 2. Also attached to the connecting straps 3 are gutter grabber straps 4 that are tethered to the gutter grabber devices 1. In some preferred embodiments, the gutter grabber straps 4 are stitched to the connecting straps 3. These straps 4 prevent the gutter grabber devices 1 from being accidentally dropped to the ground by the user before he attaches them to the gutter's edge. In a preferred embodiment, the straps 4 are each only ⅛" wide as they will be bearing no pressure. In preferred embodiments, the straps are also each approximately 12 inches long.

The straps 3, 4, and 6 may be made of any strong, durable, preferably lightweight material capable of withstanding the forces exerted on them during use. The connecting straps 3 and/or the gutter grabber straps 4 are preferably made of the same material as the lashing straps 6, but in other embodiments, the straps, 3, 4, and/or 6 may be made of different materials. In some embodiments, the straps 3, 4, and 6 are made of materials known to be used for lashing straps or tie-down straps. In some embodiments, the straps 3, 4, and/or 6 are made of a synthetic woven material that is very strong, such as polypropylene, polyester or nylon.

Figure 2:
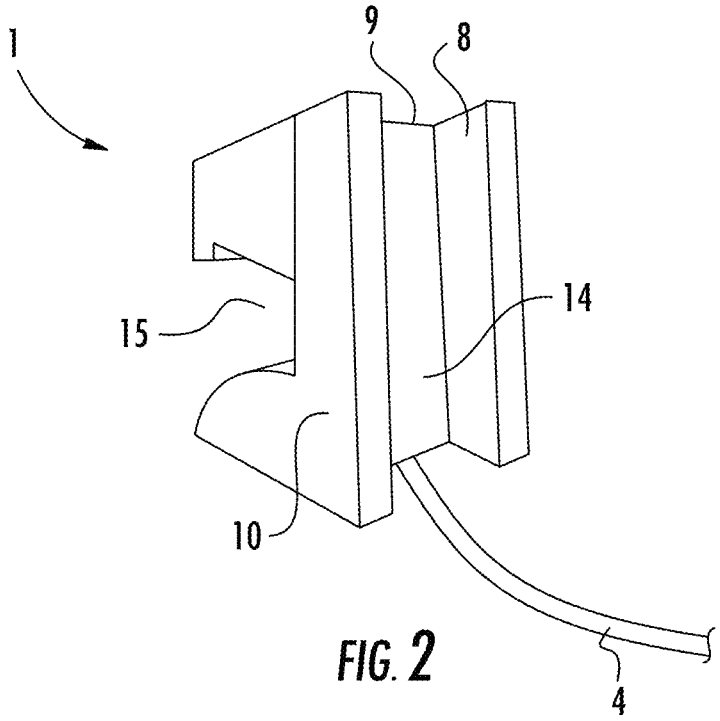
FIG. 2 is a perspective view of a gutter grabber device showing the ladder rail face.
Figure 4B:
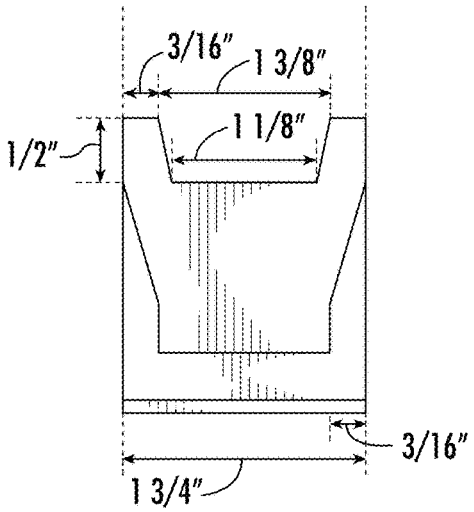
FIG. 4B shows a top view of the gutter grabber device, with some preferred dimensions for the device.
Figure 5B:
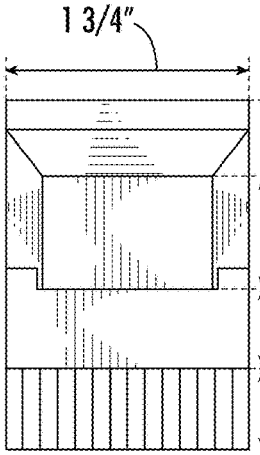
FIG. 5B shows a rear view of the gutter grabber device, with some preferred dimensions for the device.
Figure 6B:
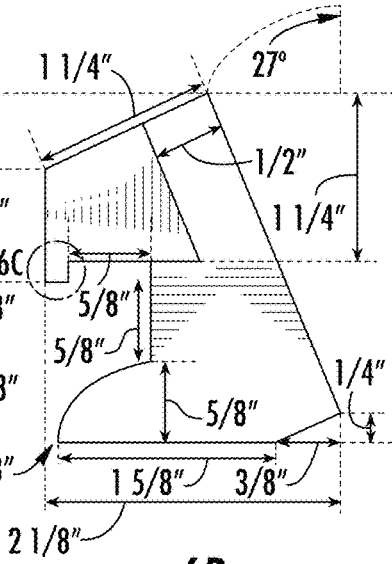
FIG. 6B shows a side view of the gutter face of the gutter grabber device, with some preferred dimensions for the device.
Figure 7B:
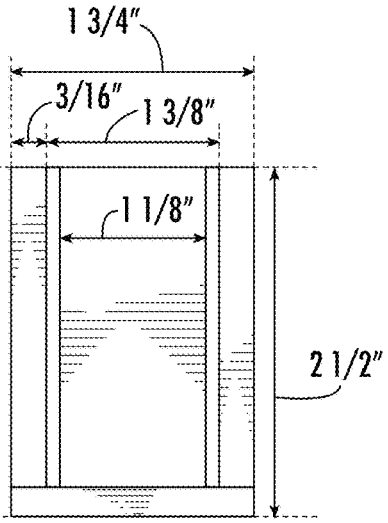
FIG. 7B shows a frontal view of the gutter grabber device, with some preferred dimensions of the device.
Figure 6C:
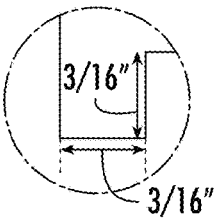
FIG. 6C shows a blown up view of the gutter protrusion portion of the gutter rail face of FIG. 6A, with some preferred dimensions for the device.

FIG. 2 is a perspective view of the gutter grabber devices 1 showing the ladder rail face. Gutter grabber ladder channel sides 8 are sized for all ladders to fit. In one embodiment, the mouth of the channel 14 is ¼" wider than the widest ladder's rail to allow plenty of extra space to allow the setting of the ladder rail. In one embodiment, the inner face 9 of the channel 14 is ½" deep and 1⅛" wide; which is tapered down from 1⅜" inch at the mouth, to keep the ladder rail from moving within the channel 14, as shown in FIG. 4B.

Figure 3:
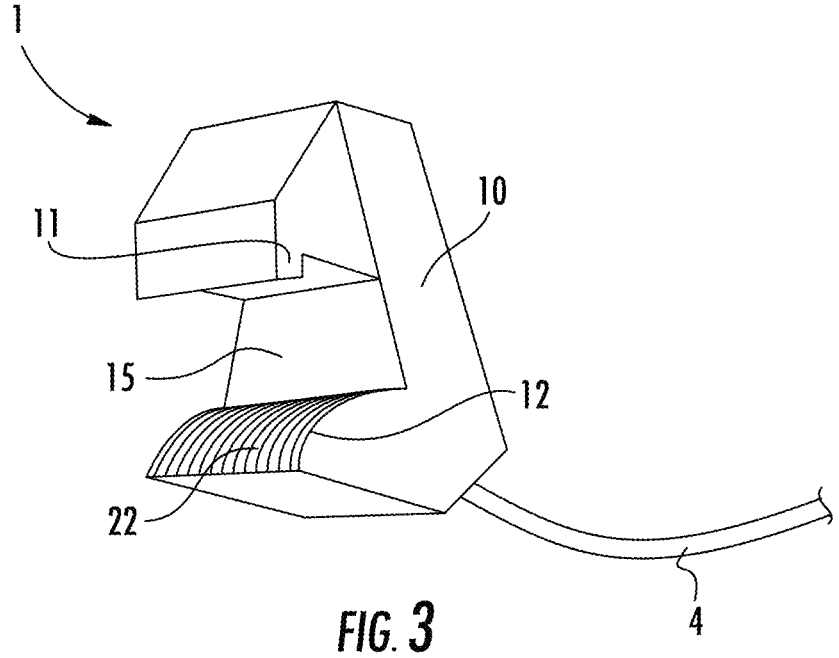
FIG. 3 is a perspective view of a gutter grabber device showing the gutter face.
Figure 6A:
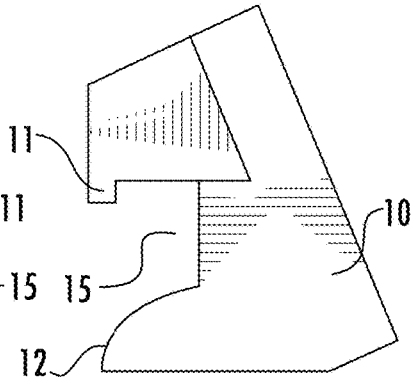
FIG. 6A is a side view of the gutter grabber device.
Figure 7A:
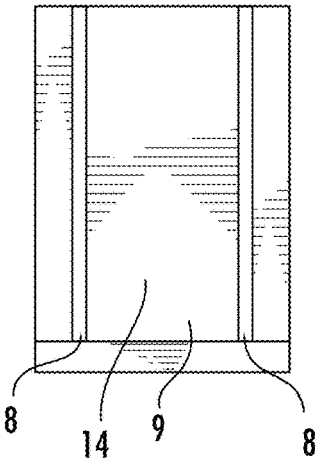
FIG. 7A shows a frontal view of the gutter grabber device showing the ladder rail face.

FIGS. 3 and 6A show the shape of the gutter face of the gutter grabber device 1. The gutter face is molded to fit snugly against the gutter's edge 13 and also fits on gutters with leaf guards attached to them. The interior gutter protrusion 11 is specifically designed to provide hold against the inside edge of the gutter 16 as well as the top of the gutter 16 providing the gutter does not have any leaf guards. If the gutter 16 does have leaf guards, the preferred 3⁄16" of protrusion is not be "too high" to prevent the gutter grabber device 1 from sitting atop the leaf guard while the mold of the gutter grabber device 1 fits the gutter's edge 13 and lower lip 21. The lower lip 12 of the gutter face rubs against the gutter 16 to help neutralize sideward pressure. In preferred embodiments, the lip 12 of the gutter face includes treads 22 (like a tire) to increase pressure, for example by 50%.

Some preferred dimensions for the gutter grabber devices 1 are shown in FIGS. 4B, 5B, 6B, 6C, and 7B. However, other dimensions to fit other size ladder rails and/or other size and shaped gutters are also possible.

Figure 8:
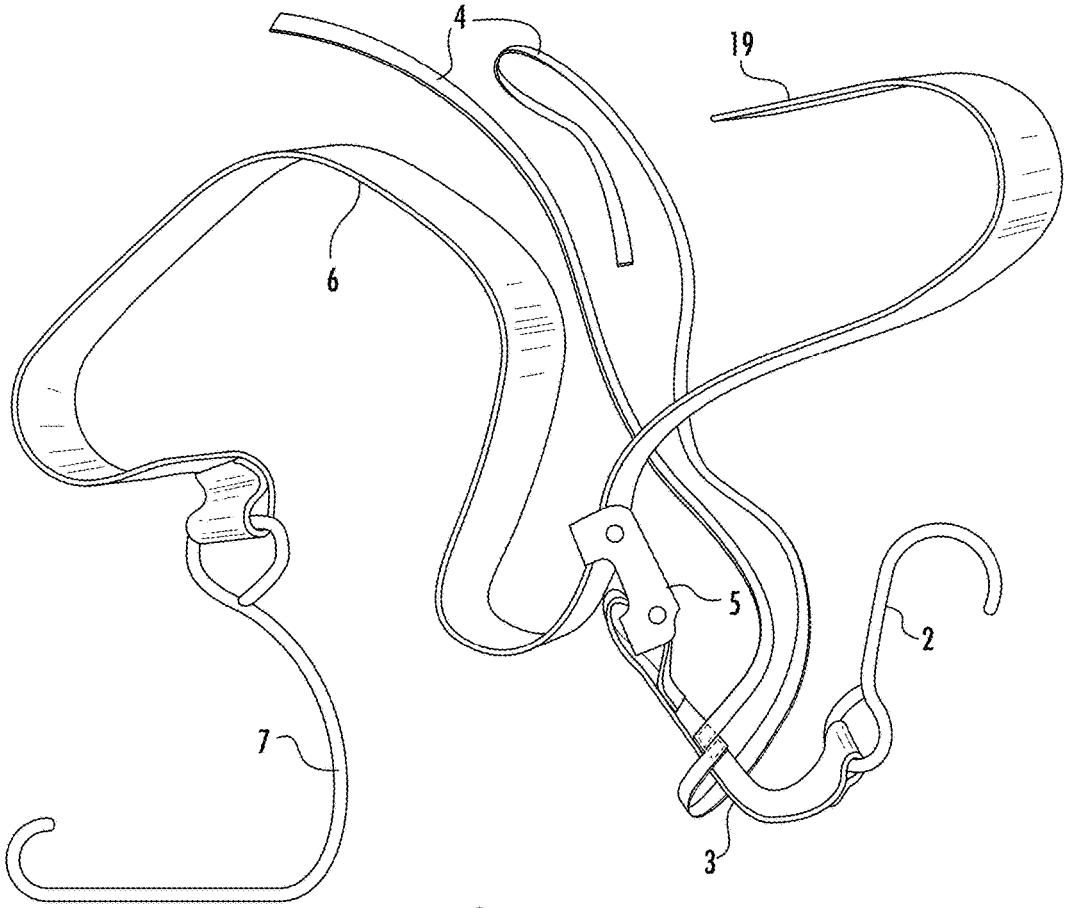
FIG. 8 is a view of the safety device, without the gutter grabber device.

FIG. 8 shows the ratchet, strap and hook portion of the device, detached from a gutter 16 or a ladder 17. While not preferred, in other embodiments, the gutter grabber devices 1 may be used alone, without the ratcheting device 5, hooks 2, 7, and straps, 3, 4, 6, shown in FIG. 8. Their use alone still permits a safe sturdy connection between a ladder 17 and gutter 16 during use of the ladder 17. The gutter grabber devices 1 are also small enough, used alone, to be safely carried up a ladder 17, for example in a user's pocket, in a carrying case, or directly on a tool belt.

Figure 9:
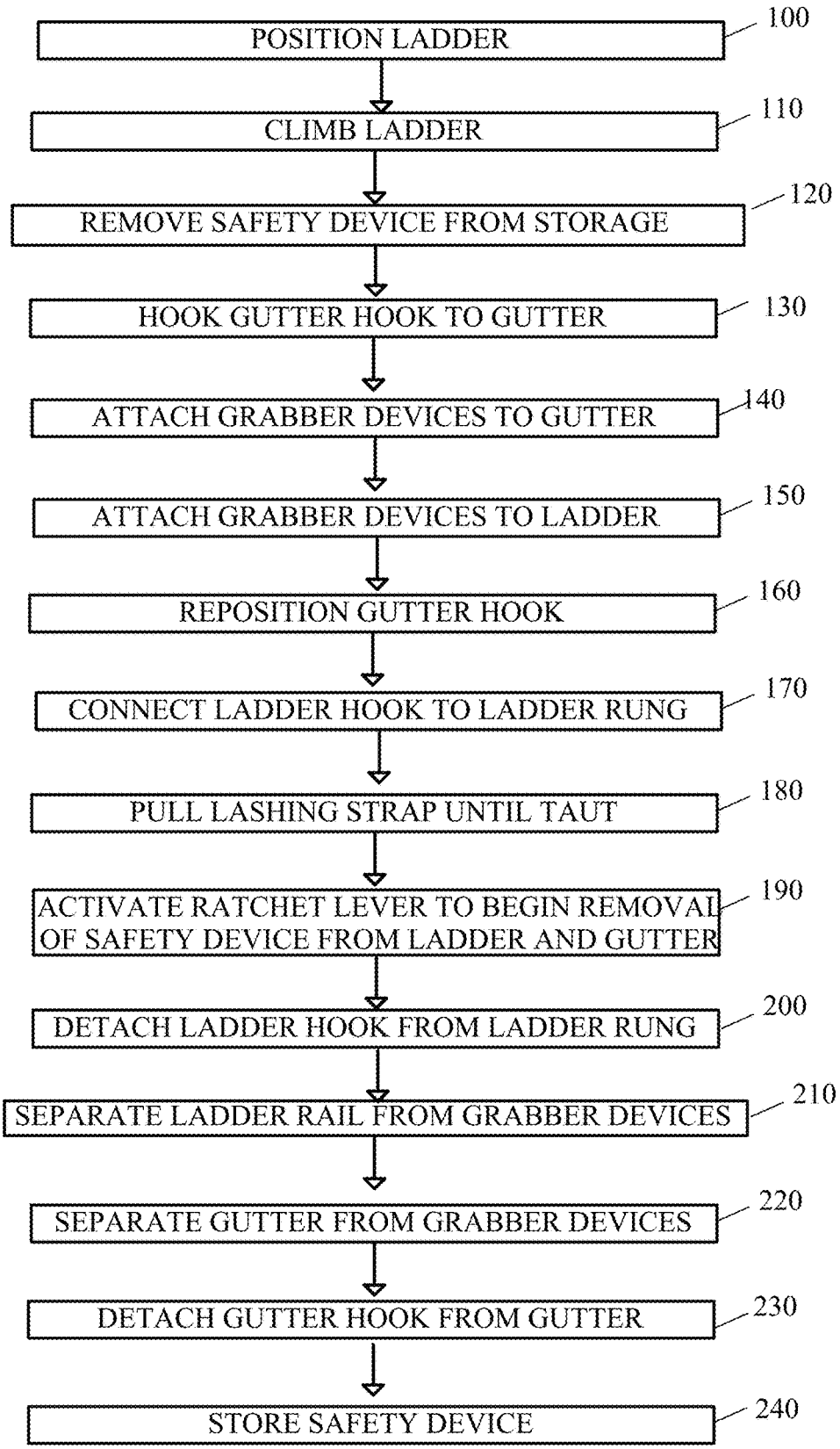
FIG. 9 shows a flowchart of a method of using the safety device.

One method of using the safety device is described below and shown in FIG. 9. The ladder 17 is positioned in accordance with any safety warnings for the ladder 17 in step 100. Once the ladder 17 is positioned, the user climbs the ladder 17, preferably until his face is about level with the gutter 16, in step 110. If the safety device has been stored, it is removed from storage in step 120. For example, if the safety device is being stored in a carrying case, the safety device is removed from the carrying case, which is preferably on a tool belt, in step 120. As another example, the safety device may have been stored in a user's pocket. Removal of the safety device from storage may occur before or after the user has climbed the ladder 17. The gutter hook 2 is inserted onto the gutter 16 in step 130. The hook 2 and the strap 3 should hang between the third 23 and fourth rung 18 down from the top of the ladder. The fourth rung 18 is also preferably the rung immediately below the gutter 16.

The gutter grabber devices 1 are each attached to the gutter 16 in step 140. The devices 1 are preferably placed so that they are both either to the left (as shown in FIG. 1) or to the right of the ladder rail 24 leaning on the gutter 16; placing them so that they are touching the ladder rail 24 where it lies on the gutter 16. The gutter grabber devices 1 are each attached to the ladder rails 24 in step 150. The ladder 17 is preferably carefully lifted off the gutter 16 and the ladder rails 24 are each placed into a groove or channel 14 of one of the gutter grabber devices 1. One hand is preferably used to push the ladder 17 up and off the gutter 16, while the other hand directs the ladder rails 24 into the channels 14. The ladder rails 24 can be fitted sequentially into the channels 14 of the gutter grabber devices 1 or be fitted simultaneously.

The gutter hook 2 is then preferably repositioned so that it is centrally located between the ladder rails 24 in step 160. The ladder hook 7 is connected to the ladder rung 18 in step 170. The end of the safety strap 6 with the ladder hook 7 on it is pulled towards the user, and then preferably wrapped under the ladder rung 18 immediately below the gutter 16. This is preferably repeated so that the lashing strap 6 is loosely wrapped around the rung 18 twice and the ladder hook 7 is attached to the ladder rung 18. The free end 19 of the lashing strap 6 is pulled until taut in step 180. The user can now safely perform whatever actions he needs to perform on the gutters and/or the roof without the ladder moving or sliding dangerously from side to side.

To begin removal of the safety device when the user is ready to dismount from the ladder (for example, when his work on the roof and/or in the gutter has been completed), the ratchet 5 lever is activated to loosen tension on the strap 6 in step 190. Simultaneously, the ratchet device 5 is pulled to allow the loose end 19 of the strap 6 to thread back through it until there is enough slack to allow removal of the safety strap 6. The ladder hook 7 is detached from the ladder rung 18 in step 200. The ladder rails 24 are lifted off the gutter grabber devices 1 in step 210 and the gutter grabber devices 1 are removed from the gutter 16 in step 220. The gutter hook 2 is detached from the gutter in step 230. The safety device is preferably stored in step 240. The safety device may be temporarily stored, for example in a user's pocket, before climbing back down the ladder 17. If a carrying case and a tool belt are being utilized, the safety device is preferably placed back into the carrying case on the tool belt.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A ladder safety device comprising at least one gutter grabber device, comprising:

a gutter grabber device body having a first side and a second side opposite the first side;

an angled ladder rail face on the first side of the device body, comprising two substantially parallel ladder rail face side walls extending away from the device body and forming a channel sized and angled to fit a side rail of a ladder; and a gutter face on the second side of the device body, comprising a gutter face top wall and a gutter face bottom wall both extending away from the device body and forming a cavity sized and shaped to fit a gutter; a ratcheting device having a first end and a second end;

a first strap having a first end attached to the first end of the ratcheting device, and a second end;

a second strap attached at a first end to the first strap and a second end tethered to a first gutter grabber device body;

a third strap, attached at a first end to the first strap and a second end tethered to a second gutter grabber device body; and a fourth strap having a first end and a second end and a fourth strap body therebetween, the fourth strap being attached to the second end of the ratcheting device at a location along the fourth strap body.

2. The ladder safety device of claim 1, wherein the gutter grabber device further comprises a protrusion at an outer end of the gutter face top wall that extends towards the bottom wall.

3. The ladder safety device of claim 1, wherein the gutter face bottom wall is curved downward away from the device body.

4. The ladder safety device of claim 1, wherein the gutter face bottom wall comprises a plurality of treads on a surface of the bottom wall facing the cavity.

5. The ladder safety device of claim 1, wherein the gutter grabber device is a single solid piece.

6. The ladder safety device of claim 1, wherein the gutter grabber device is made of rubber.

7. The ladder safety device of claim 1, wherein the gutter grabber device is shaped to attach to gutters including at least one leaf guard.

8. The ladder safety device of claim 1, further comprising a first hook sized to hook to an inside of a gutter and attached to the second end of the first strap, and a second hook sized to hook to a ladder rung and attached to the first end of the fourth strap.

9. A ladder safety device comprising:

a) at least two gutter grabber devices, each comprising:

a gutter grabber device body having a first side and a second side opposite the first side;

an angled ladder rail face on the first side of the device body, comprising two substantially parallel ladder rail face side walls extending away from the device body and forming a channel sized and angled to fit a side rail of a ladder; and a gutter face on the second side of the device body, comprising a gutter face top wall and a gutter face bottom wall both extending away from the device body and forming a cavity sized and shaped to fit a gutter;

b) a ratcheting device having a first end and a second end;

c) a first strap having a first end attached to the first end of the ratcheting device, and a second end;

d) a second strap attached at a first end to the first strap and a second end tethered to a first gutter grabber device body;

e) a third strap, attached at a first end to the first strap and a second end tethered to a second gutter grabber device body; and f) a fourth strap having a first end and a second end and a fourth strap body therebetween, the fourth strap being attached to the second end of the ratcheting device at a location along the fourth strap body;

g) a first hook sized to hook to an inside of a gutter and attached to the second end of the first strap; and h) a second hook sized to hook to a ladder rung and attached to the first end of the fourth strap.

10. The ladder safety device of claim 9, wherein each gutter grabber device further comprises a protrusion at an outer end of the gutter face top wall that extends towards the bottom wall.

11. The ladder safety device of claim 9, wherein the gutter face bottom wall is curved downward away from the device body.

12. The ladder safety device of claim 9, wherein the gutter face bottom wall comprises a plurality of treads on a side of the bottom wall facing the cavity.

13. The ladder safety device of claim 9, wherein the gutter grabber devices are a single solid piece.

14. The ladder safety device of claim 9, wherein the gutter grabber devices are made of rubber.

15. The ladder safety device of claim 9, wherein the gutter grabber devices are shaped to attach to gutters including at least one leaf guard.

16. A method of safely mounting a ladder to a gutter using a ladder safety device comprising at least two gutter grabber safety devices, each gutter grabber safety device comprising a gutter grabber device body having a first side and a second side opposite the first side, an angled ladder rail face on the first side of the device body, comprising two substantially parallel ladder rail face side walls extending away from the device body and forming a channel sized and angled to fit a side rail of a ladder, and a gutter face on the second side of the device body, comprising a gutter face top wall and a gutter face bottom wall both extending away from the device body and forming a cavity sized and shaped to fit a gutter; a ratcheting device having a first end and a second end; a first strap having a first end attached to the first end of the ratcheting device, and a second end; a second strap attached at a first end to the first strap and a second end tethered to a first gutter grabber device body; a third strap, attached at a first end to the first strap and a second end tethered to a second gutter grabber device body; and a fourth strap having a first end and a second end and a fourth strap body therebetween, the fourth strap being attached to the second end of the ratcheting device at a location along the fourth strap body; a first hook sized to hook to an inside of a gutter and attached to the second end of the first strap; and a second hook sized to hook to a ladder rung and attached to the first end of the fourth strap, comprising the step of:

a) reversibly affixing at least one gutter grabber safety device to each of the two side rails of the ladder and to a face of the gutter, each gutter grabber safety device comprising a gutter grabber device body having a first side and a second side opposite the first side, an angled ladder rail face on the first side of the device body, comprising two substantially parallel ladder rail face side walls extending away from the device body and forming a channel sized and angled to fit a side rail of a ladder, and a gutter face on the second side of the device body, comprising a gutter face top wall and a gutter face bottom wall both extending away from the device body and forming a cavity sized and shaped to fit a gutter.

17. The method of claim 16, further comprising the step of:

d) activating the ratchet device to loosen the first strap; and e) detaching the gutter grabber device from each of the two side rails of the ladder and the face of the gutter.

18. The method of claim 16, further comprising the steps of:

f) detaching the first hook from the gutter; and g) detaching the second hook from the ladder rung.

* * * * *